United States Patent [19]

Leahy et al.

[11] 4,067,784

[45] Jan. 10, 1978

[54] NON-CYANIDE ACIDIC SILVER ELECTROPLATING BATH AND ADDITIVE THEREFORE

[75] Inventors: Elizabeth P. Leahy, North Caldwell; George A. Karustis, Westfield, both of N.J.

[73] Assignee: Oxy Metal Industries Corporation, Warren, Mich.

[21] Appl. No.: 694,108

[22] Filed: June 9, 1976

[51] Int. Cl.[2] ..... C25D 3/46

[52] U.S. Cl. ..... 204/46 R; 204/DIG. 2; 252/182

[58] Field of Search ..... 204/43 R, 46 R, 109, 204/DIG. 2; 106/1; 252/182

[56] References Cited

U.S. PATENT DOCUMENTS 3,980,531 9/1976 Ludwig et al. ..... 204/43 R

OTHER PUBLICATIONS

S. R. Natarajan et al., Metal Finishing, pp. 51–56, Feb. 1971.

K. Hickman et al., Industrial & Engineering Chem., vol. 25, pp. 202–212, Feb. 1933.

*Primary Examiner*—G. L. Kaplan

*Attorney, Agent, or Firm*—B. F. Claeboe; Richard P. Mueller; Arthur E. Kluegel

[57] ABSTRACT

A non-cyanide acidic silver electroplating bath contains a soluble silver salt, a thiosulfate, a bisulfite buffer and a sulfate.

4 Claims, No Drawings

NON-CYANIDE ACIDIC SILVER ELECTROPLATING BATH AND ADDITIVE THEREFORE

BACKGROUND OF THE INVENTION

Silver is traditionally deposited from alkaline solutions, and particularly cyanide solutions because they are inexpensive and the alkaline cyanide complex is stable toward light. In the late 1950's, acid gold electrolytes were developed when it was discovered that alkali gold cyanide was stable at a pH as low as 3.0. Sodium and potassium silver cyanides do not have the stability of alkali gold cyanide in acid solutions and, consequently, no corresponding acid silver plating solutions were developed until the mid-1960's. It was then discovered that potassium silver cyanide, if buffered in the region of 6.0 or 6.5 to 7, would remain reasonably stable and also that relatively small amounts of an alkali metal or ammonium thiocyanate could stabilize the silver plating bath.

As is apparent, it is desirable to utilize silver plating solutions in which cyanide is not present because cyanide is a well known poison. In addition, some people are allergic to the chemical and develop severe rashes on contact with cyanide. Several attempts have been made in the past to develop an acidic solution without the use of cyanide but these have proven to be sensitive to light and the silver is eventually reduced to the metal by the action of the shorter wave lengths of visible light and also by It is the object of this invention to provide an acidic silver plating bath which does not employ cyanide and which is stable. This and other objects of the invention will become apparent to those skilled in the art of the following detailed description.

SUMMARY OF THE INVENTION

This invention relates to a non-cyanide acidic silver electroplating bath and more particularly to a bath containing a soluble silver salt, a thiosulphate, a bisulfite buffer and a sulfate.

DESCRIPTION OF THE PREFERRED EMBODIMENTS

In accordance with this invention, a non-cyanide acidic silver electoplating bath is provided containing a soluble silver salt, a thiosulphate, a bisulfite buffer, and a sulfate.

Any non-cyanide water soluble silver salt can be used in the electroplating bath of this invention. For example, any of the silver halides (silver chloride, silver bromide, silver iodide or silver floride) can be used as well as silver thiosulphate, silver sulphate, silver sulfamate, silver fluoroborate, silver nitrate and the like. From the standpoint of availability and price, the preferred silver salt is silver chloride. The silver salt is employed in a concentration of about 5 to 50 grams of silver per liter of solution and preferably 30 to 35 grams per liter.

The thiosulphate employed can be any of the alkali metal thiosulphates or ammonium thiosulphate. The preferred thiosulphate is sodium thiosulphte. The purpose of the thiosulphate is to complex the silver and therefore the concentration in the electroplating bath is a direct function of the silver concentration. It is preferred to employ about two moles of thiosulphate for each mole of silver present but higher concentrations can be used if desired.

The electroplating bath of the instant invention also contains a suitable bisulfite buffer in an amount sufficient to buffer the bath at a pH of about 3.5 to 7.0 and preferably about 4.5 to 5.5. The alkali metal bisulfite buffers and particularly a sodium bisulphite buffer system, are preferred buffers and can be present in concentrations of about 4 grams per liter to saturation. When employing sodium bisulphite, it appears that a concentration of about 40 grams per liter is optimum and is therefore preferred to utilize this concentration.

The present electroplating bath also contains an alkali metal sulphate, preferably sodium sulphate, in a concentration which can vary from about 4 grams per liter to saturation. It has been found that for some unknown reason, the sulphate acts to stabilize the electroplating bath so that the electrolyte is, in addition to being mildly acidic, stable in sunlight and capable of providing a coherent, continuous, matte deposit of silver. It has been observed that the quantity of sulphate within the stated range does not materially affect the performance of the electrolyte and, therefore, for economic reasons, it is preferred to maintain the concentration at the lower levels of, e.g., about 4 to 20 grams per liter.

It will be recognized by those skilled in the art that, if desired, a mixture of soluble silver salts, of thiosulphates, bisulfite buffers and sulphates can be used. Additionally, the electroplating solution of the instant invention can also contain brighteners and other additives known to those skilled in the art.

A two part brightener system has been found to be particularly advantageous for the acid silver electrolytes of this invention. The brightener system contains surfactants and non-polymeric brightener materials. The surfactant part of the system contains at least one anionic sulfonic acid derivative surfactant, at least one amphoteric nitrogen containing carboxylic or sulfonic acid derivative surfactant and at least one cationic or non-ionic surfactant.

The brightener portion of the system contains at least one electrolysis stable soluble aldehyde and at least one C=S containing a compound or tautomers thereof. Each member of the brightener system can be present in an amount of from about one milligram per liter to saturation. In order to avoid hazy deposits, it is preferred to use up to 0.075 g/l of anionic surfactant, up to 0.4 g/l amphoteric surfactant, up to 0.9 g/l cationic or non-ionic surfactant, up to 1.1 g/l aldehyde and up to 0.03 g/l C=S containing compound. If concentrations beyond the preferred amounts are employed, the resulting coating, while hazy, retains the integrity and functionality of the deposit.

Typical anionic sulfonic acid derivative surfactants include Turkey Red Oil (sulfonated castor oil), 1,3,6-napthalene trisulfonic acid, 2-napthalene sulfonic acid and the like. Among the suitable amphoteric surfactants, Tegobentaine C, Antaron FC-34 (a complex fatty amino amphoteric surfactant), and sulfonated fatty acid amides such as Miranol HM, JS, J2MSF or HS, and Triton QS-15 can be employed. Suitable cationic or non-ionic surfactants include Tween 40 (polyoxyethylene sorbitan monooleate, a non-ionic material), Katapol VP-532 (a cationic fatty acid plus polyethylene ether derivative of an organo ammonium sulfate), Katapol PN-430 (a cationic polyoxyethylated alkylamine of specific gravity of 0.94), Peregal OK (a cationic methyl polyethanol quaternary amine) and the like are suitable.

Typical aldehydes include furfural, anisic aldehyde, cinnamaldehyde, glutaraldehyde, benzaldehyde, dimethylamino benzaldehyde and the like. Typical C=S containing compounds include methyl imidazol thiol and dithizone.

The electoplating solution of the instant invention is utilized in the conventional way. For example, a solution can be vigorously agitated with a solution sparger or by movement of the cathode and electrodeposition can be carried out at 10 amps per square foot at essentially 100% efficiency. In general, a current density of about 1 to 50 amps per square foot is suitable and, while it is preferred to carry out the electrodeposition at ambient temperature, either higher or lower temperature can be employed.

EXAMPLE 1

An electroylic bath was made by dissolving the following components in sufficient water to obtain one liter of solution:

| | |
|---|---|
| Silver Chloride | 11.36 grams |
| Sodium Thiosulphate | 35.93 grams |
| Sodium Bisulphite | 4.22 grams |
| Sodium Sulphate | 10.56 grams |

A clean and polished steel body was made the cathode in the foregoing bath and electrodeposition was carried out at a current density of 10 amps per square foot while the bath was maintained at a temperature of about 70° F. A coherent, continuous, matte deposit of silver was obtained.

EXAMPLE 2

An electroylic bath was made by dissolving silver chloride at one troy ounce per gallon, sodium thiosulphate at 36 grams per liter, sodium bisulphite at 40 grams per liter and sodium sulphate at four grams per liter in water. A clean and polished steel body was used as a cathode and the solution was vigorously agitated by movement of the cathode. Electrodeposition was carried at ten amps per square foot to produce a coherent, continuous matte deposit of silver.

EXAMPLE 3

An acidic non-cyanide silver electroplating bath was prepared containing about 11.5 grams of silver chloride, about 36 grams of sodium thiosulfate, about 4.25 grams of sodium bisulfite and about 10.5 grams of sodium sulfate. The solution had a pH of 4.5 to 5.0.

To one liter of the silver solution, two ml/l of 1% methyl imidazol thiol, 0.5 ml/l furfural, 0.5 ml/l Turkey Red Oil, 0.1 gram of Triton QS-15 and 0.6 gram of Katapol VP-532 were added.

Silver electroplating was carried out with the resulting solution at 10 amps per square foot at room temperature and with solution agitation. The resulting silver was mirror bright. The deposit had a low porosity and tarnished at a noticeably slower rate than ordinary silver.

Various changes and modifications can be made in the electroplating bath of this invention without departing from the spirit and scope thereof. For example, while those skilled in the art will recognize that the instant solution is stable to light, it is preferred to shield the solution from any unnecessary exposure to light. The various embodiments set forth herein were for the purpose of further illustrating the invention but were not intended to limit it.

What is claimed is:

1. An aqueous non-cyanide acidic silver electoplating bath, which comprises a water soluble silver salt in a concentration of about 5 to 50 grams of silver per liter of solution, sodium thiosulfate present in an amount of about two moles of thiosulfate for each mole of silver in said silver salt, a bisulphite buffer in the form of sodium bisulphite present in an amount of about 4 grams per liter to saturation, and a sulfate in the form of an alkaline metal sulfate present in an amount of about 4 grams per liter to saturation, said solution having a pH of about 3.5 to 7.0, said solution further including a brightener system which comprises at least one anionic sulfonic acid derivative surfactant, at least one amphoteric nitrogen containing carboxylic or sulfonic derivative surfactant, at least one cationic or non-ionic surfactant, at least one solution stable soluble aldehyde, and at least one C=S containing compound or tautomer thereof.

2. An electroplating bath as defined in claim 1, in which the anionic surfactant is present in an amount up to about 0.075 grams per liter, said amphoteric surfactant is present in an amount up to about 0.4 grams per liter, said cationic or non-ionic surfactant is present in an amount up to approximately 0.9 grams per liter, said aldehyde is present in an amount up to about 1.1 grams per liter, and said C=S containing compound is present in an amount of approximately 0.03 grams per liter.

3. A brightener system especially adapted for use in aqueous non-cyanide acid silver electroplating solutions which comprises, in aqueous solution, at least one anionic sulfonic acid derivative surfactant, at least one amphoteric nitrogen containing carboxylic or sulfonic derivative surfactant, at least one cationic or non-ionic surfactant, at least one electrolysis stable soluble aldehyde, and at least one C=S containing compound or tautomer thereof.

4. A brightener system as defined in claim 3, in which the anionic surfactant is Turkey Red Oil, said aldehyde is furfural, and said C=S containing compound is methyl imidazol thiol.

* * * * *